United States Patent [19]

Greb et al.

[11] Patent Number: 5,072,157

[45] Date of Patent: Dec. 10, 1991

[54] EXCITATION DEVICE SUITABLE FOR EXCITING SURFACE WAVES IN A DISCHARGE TUBE

[75] Inventors: Ulrich Greb, Cossington; Martin C. Steel, Reading; Richard W. Burton, Ely, all of England

[73] Assignee: Thorn EMI plc, London, England

[21] Appl. No.: 401,416

[22] Filed: Sep. 1, 1989

[30] Foreign Application Priority Data

Sep. 2, 1988 [GB] United Kingdom ..... 8821672

[51] Int. Cl.[5] ..... H05B 41/16

[52] U.S. Cl. ..... 315/248; 315/344; 315/39; 313/607

[58] Field of Search ..... 315/111.21, 111.51, 315/248, 344, 39; 219/10.55 R; 313/607, 234

[56] References Cited

U.S. PATENT DOCUMENTS 4,049,940 9/1977 Moisan ..... 315/111.21
4,473,736 9/1984 Bloyet ..... 315/111.21
4,715,054 12/1987 Kato ..... 315/111.21
4,792,725 12/1988 Levy ..... 315/111.21
4,810,933 3/1989 Moisan ..... 315/248
4,906,898 3/1990 Moisan ..... 315/248

*Primary Examiner*—Eugene R. LaRoche
*Assistant Examiner*—Amir Zarabian
*Attorney, Agent, or Firm*—Fleit, Jacobson, Cohn, Price, Holman & Stern

[57] ABSTRACT

A discharge tube arrangement comprises an excitation device and a discharge tube made of a light-transmissive dielectric material and containing a fill. The excitation device is suitable, when energized with radio frequency (r.f.) power, for exciting surface waves in the discharge tube. The excitation device includes a launcher and a plurality of electrical components associated with the supply of r.f. power to the launcher and constituting at least one of an impedance matching network and a part at least of means to generate r.f. power. This plurality of electrical components is positioned in the launcher between its inner and outer tubes.

5 Claims, 2 Drawing Sheets

EXCITATION DEVICE SUITABLE FOR EXCITING SURFACE WAVES IN A DISCHARGE TUBE

This invention relates to a discharge tube arrangement and in particular, though not exclusively, to such an arrangement for use as a light source. In particular, this invention relates to a structure, known as a launcher, for such a discharge tube arrangement.

It is known to generate and sustain a discharge in a gas using electromagnetic surface waves. Surface waves are created by a launcher which is positioned around and external of, but not extending the whole length of, a discharge tube containing the gas. In such an arrangement, it is not necessary to provide electrodes inside the discharge tube. The power to generate the electromagnetic wave is provided by a radio frequency (r.f.) power generator.

U.S. Pat. No. 4,049,940 (Moisan et al) discloses two types of launcher, known as a 'surfatron' and a 'surfaguide' in which a single integrated unit serves as the wave launcher as well as acting as an impedance matching structure for efficient transfer of power from the r.f. power generator to the discharge tube. A major problem with such launchers is their size which is related, inter alia, to the frequency of the required electromagnetic wave e.g. an 80-MHz surfatron extends more than 0.5 m along the axial length of the discharge tube. Conversely, for such launchers, the lower limit for the operating frequency does not follow from their principle of operation but from practical considerations—at submicrowave frequencies, the launchers become large, expensive and usually cumbersome. The size and shape of the launcher provide what is termed 'internal matching'.

M. Moisan and Z. Zakrzewski "New surface wave launchers for sustaining plasma columns at submicrowave frequencies (1–300 MHz)" Rev. Sci. Instrum 58 (10), October 1987, disclose a launcher with an impedance-matching network to provide what is termed 'external matching'. A typical launcher for use with an impedance—matching network is shown in FIG. 1. The launcher 2 comprises an inner aluminium tube 4 and an outer aluminium tube 6 coaxial with the inner tube 4. One end of the outer tube 6 is closed by a steel plate 8. The inner tube 4 is shorter than the outer tube 6 and accordingly an annular launching gap 10 is defined between the end of the inner tube 4 and the steel plate 8. At the other end of the launcher, an aluminium metal plate 12 extends perpendicularly from the inner tube 4 towards the outer tube 6 almost closing that end of the launcher. An annular field arresting gap 14 between the outer edge of the plate 12 and the outer tube 6 confines the field existing between the inner and outer tubes 4, 6. This gap allows a non-zero potential difference to be generated in the launching gap 10. A Teflon disc 15 adjacent the field arresting gap 14 holds the plate 12 and the inner tube 4 in position relative to the outer tube 6 and reduces, to a certain extent, the leakage of r.f. power from the field arresting gap 14. R.f. power is supplied to the launcher via a connector 15 and an impedance matching network 16 (shown schematically) consisting of inductors and capacitors. The combination of the r.f. power generator, the impedance matching network and the launcher constitute an excitation device for the gas fill in the discharge tube. Such an arrangement is larger than would be commercially acceptable.

It is an object of the present invention to provide a launcher which at least alleviates some of the problems outlined hereinbefore.

According to the present invention there is provided an excitation device suitable, when energised with radio frequency (r.f.) power, the exciting surface waves in a discharge tube containing a fill, the excitation device comprising:

a launcher comprising an inner tube for surrounding a part of a said discharge tube, an outer tube coaxial with said inner tube and a first and a second end wall, at least one of said first and second end walls having an aperture for receiving a said discharge tube;

and a plurality of electrical components associated with the supply of r.f. power to the launcher;

wherein said plurality of electrical components is positioned in the launcher between said inner and said outer tubes, said plurality of electrical components constituting an impedance matching network or a part at least of a means to generate r.f. power or both an impedance matching network and a part at least of a means to generate r.f. power.

The inventors have found that, surprisingly, the degree to which electrical components, particularly any capacitors, would be affected by electrical fields generated inside the launcher is not so great as to prevent their being positioned inside the launcher. Furthermore, it has now been appreciated that the functions of the launcher are simply to generate an oscillating electric field parallel to the longitudinal axis of the discharge body and, preferably, to provide some r.f. screening. In particular, for an externally matched launcher, the space inside the launcher is not required for impedance matching.

Accordingly, an excitation device provided in accordance with the present invention, when energised, produces an electromagnetic surface wave to generate and sustain a discharge in a discharge tube containing a fill. As the excitation device is more compact than existing excitation devices it can be used in a greater variety of situations. In particular, such an excitation device can be used in a discharge tube arrangement intended as a light source.

Embodiments of the invention will now be described, by way of example only, and with reference to the accompanying drawings in which.

Figure 3:
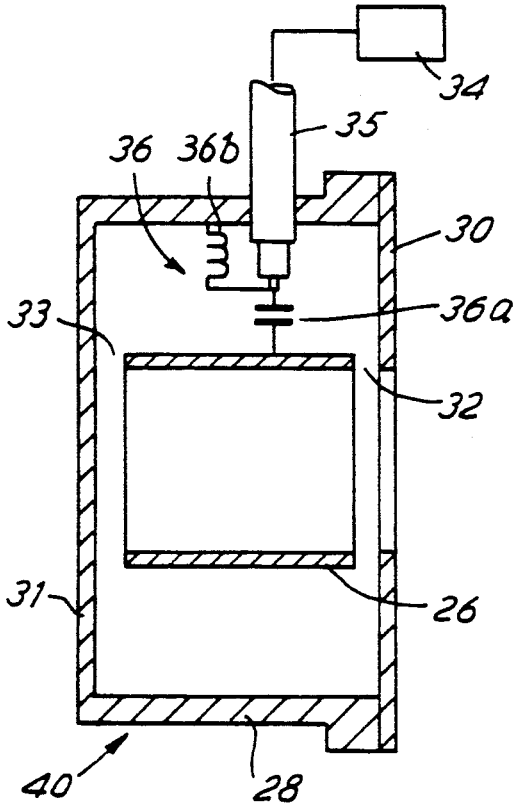
Figure 4:
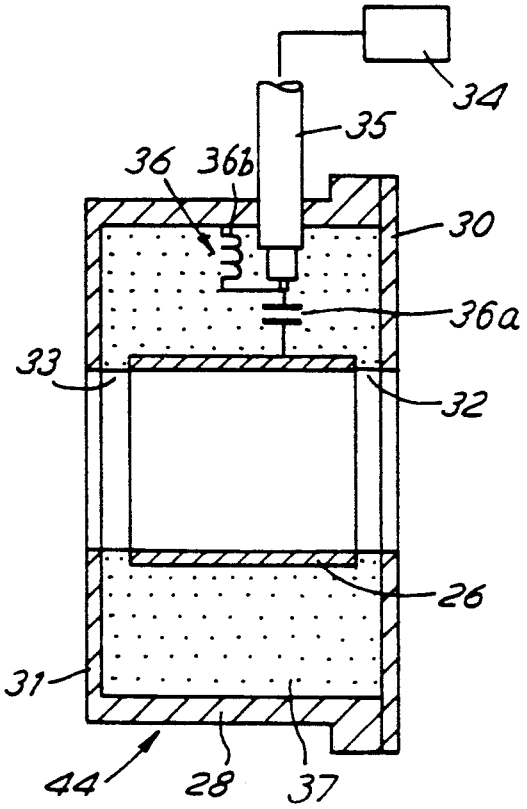
Figure 5:
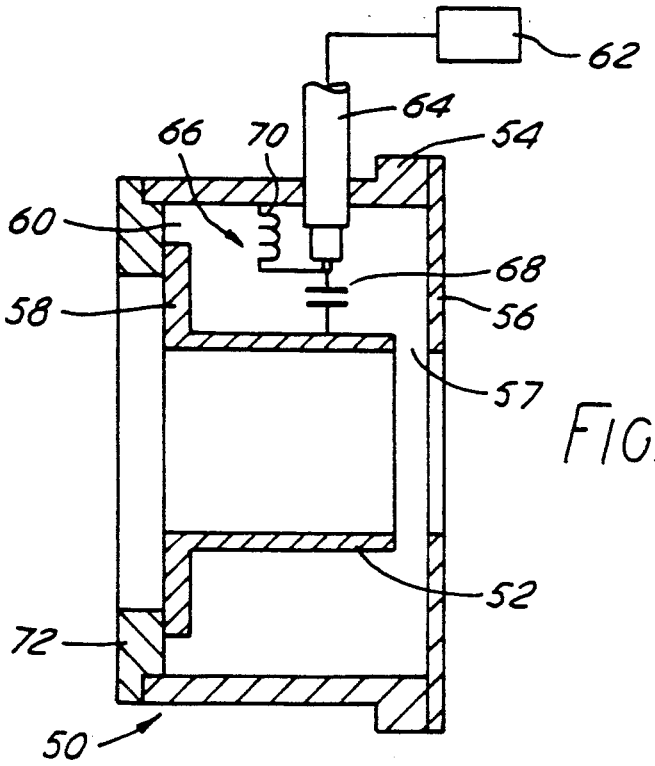

and FIGS. 3, 4 and 5 show cross-sectional side views of alternative embodiments of an excitation device provided in accordance with the present invention.

Figure 1:
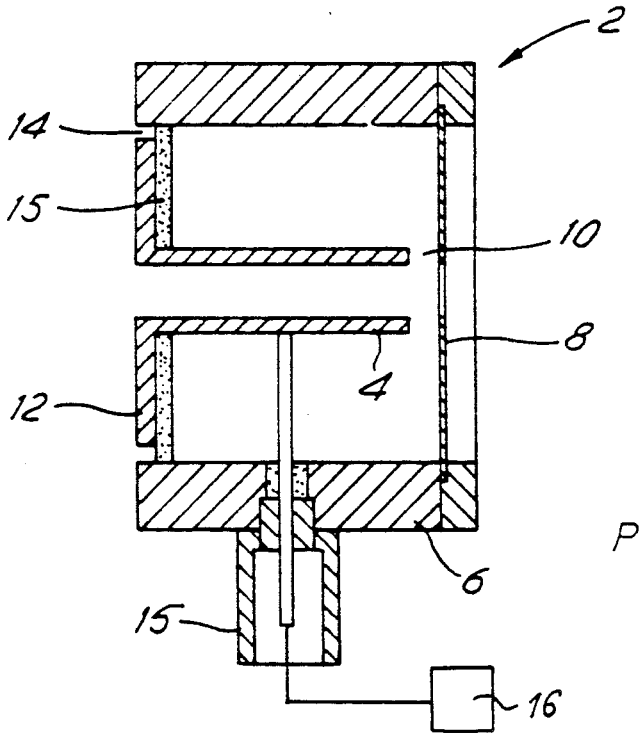
FIG. 1 PRIOR ART
FIG. 1 shows a cross-sectional side view of a known launcher as described hereinbefore.
Figure 2:
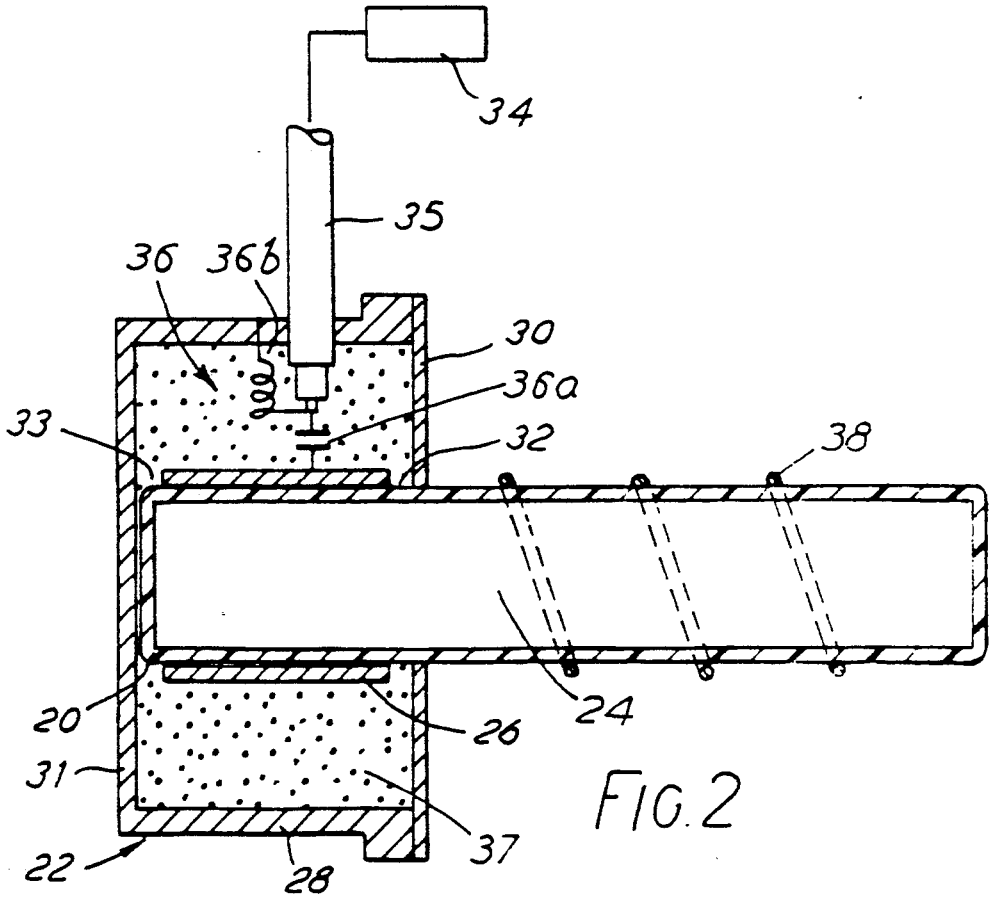
FIG. 2 shows a cross-sectional side view of a discharge tube arrangement incorporating an excitation device provided in accordance with the present invention.

As shown in FIG. 2, a discharge tube arrangement comprises a discharge tube 20 mounted in a launcher 22. The discharge tube 20 is formed of a light-transmissive, dielectric material, such as glass, and contains a fill 24 of noble gas, such as argon and an ionizable material, such as mercury.

The launcher 22 is made of an electrically conductive material, such as brass, and formed as a coaxial structure comprising an inner tube 26 and an outer tube 28. A first plate 30, at one end of the outer tube, provides a first end wall for the launcher structure. At the other end of the outer tube 28, a second plate 31, integral with the outer tube 28, provides a second end wall. The inner tube 26 is shorter than the outer tube 28 and so positioned within the outer tube 28 as to define a first annular gap 32 and a second annular gap 33. The first plate 30 has an aperture for receiving the discharge tube 20. The outer tube 28, the first plate 30 and the second plate 31 form an unbroken electrically conductive path around, but not in electrical contact with, the inner tube 26 to provide an r.f. screening structure therearound.

Suitable dimensions for the launcher of FIG. 2 are as follows:

| | |
|---|---|
| Launcher length | 7-20 mm |
| Launcher diameter (outer tube 28 diameter) | 25-35 mm but depends on size of discharge tube 20. |
| Inner tube 26 length | 3-18 mm |
| Inner tube 26 diameter | 13 mm but depends on size of discharge tube 20. |
| Length of launching gap (first gap 32) | 0.5-3 mm |
| Length of second gap 33. | 1-10 mm. |

The thickness of the electrically conductive material is of the order of millimeters, or less, depending on the construction method used.

An r.f. power generator 34 (shown schematically) is electrically connected to the launcher 22 via a coaxial cable 35 and an impedance matching network 36 (shown schematically) consisting of capacitors **36*a* and inductors 36*b*. The r.f. power generator 34, the impedance matching network 36, the coaxial cable 35 and the launcher 22** constitute an r.f. powered excitation device to energise the gas fill to produce a discharge.

A dielectric material 37 is provided inside the launcher 22, either as a structural element, e.g. to keep the size of the gaps 32, 33 constant and/or to hold the inner tube 26 in position, and/or to help in shaping the electric field in the gaps 32, 33 for ease of starting or other purposes. Suitable dielectric materials which exhibit low loss at r.f. frequencies include glass, quartz and PTFE.

When the r.f. power generator 34 is switched on, an oscillating electric field, having a frequency typically in the range of from 1 MHz to 1 GHz, is set up inside the launcher 22. At the first and second gaps 32, 33, this electric field is parallel to the longitudinal axis of the discharge tube 20. If sufficient power is applied, the consequent electric field produced in the gas fill 24 is sufficient to ionise the mercury to create a discharge through which an electromagnetic surface wave may be propagated in a similar manner to the arrangement of U.S. Pat. No. 4,049,940. Accordingly, the launcher 22 powered by the r.f. power generator 34 creates and sustains a discharge in the gas fill—the length and brightness of the discharge depending, inter alia, on the size of the discharge tube 20 and the power applied by the r.f. power generator 34. Such a discharge tube arrangement may therefore be used as a light source.

In the embodiment of FIG. 2, the first gap 32 and the second gap 33 each extend axially from respective ends of the inner tube 26, respectively to the first plate 30 and second plate 31. The discharge tube 20 extends from one end of the launcher 22 and so the first gap 32 is effective as a launching gap to create a discharge. The second gap 33 complements the effect of the first gap 32 and is advantageously larger than the first gap 32.

FIG. 2 also shows a helical structure 38, having 3 turns, and formed of an electrically conductive material, such as copper, extending along the discharge tube 20. An earth connection is provided from the structure 38 to the first plate 30 of the launcher 22. As disclosed in our copending GB Patent Application No. 8829251.1, the effect of the helical structure 38 is to enhance the light output of the discharge tube arrangement. The helical structure 38 also provides some r.f. screening.

FIG. 3 shows an alternative embodiment of a launcher provided in accordance with the present invention. The launcher 40 is formed as a coaxial structure in a similar manner to the launcher 22 of FIG. 2 and accordingly like parts are designated by like reference numerals. However, in this embodiment, the cable 35 is sufficient to hold the inner tube 26 in position and so the inside of the launcher 22 is not filled with dielectric material.

FIG. 4 shows an alternative embodiment of a launcher provided in accordance with the present invention. The launcher 44 is formed as a coaxial structure in a similar manner to the launcher 22 of FIG. 2 and accordingly like parts are designated by like reference numerals. An aperture is also provided in the second plate 31 and accordingly a discharge tube (not shown) can be positioned to extend from both sides of the launcher 44. When power is supplied, both the first gap 32 and the second gap 33 are effective as launching gaps to create a discharge. If the first and second gaps 32, 33 are the same size, this results in a relatively symmetrical discharge. As with the embodiment of FIG. 2, the r.f. power at the second gap 33 is dissipated in the discharge and not lost from the system as in prior art launchers.

FIG. 5 shows yet another embodiment of a launcher 50 provided in accordance with the present invention. The launcher 50 is made of an electrically conductive material, such as brass, and is formed as a coaxial structure comprising an inner tube 52 and an outer tube 54. A first plate 56 at one end of the outer tube 54 provides a first end wall for the launcher structure. The inner tube 52 is shorter than the outer tube 54 and accordingly an annular launching gap 57 is defined between the end of the inner tube 52 and the first plate 56. A second end wall is provided at the other end of the launcher structure by an annular flange 58 integral with and extending from the inner tube 52 towards the outer tube 54. The flange 58 does not meet the outer tube 54, there being an annular field arresting gap 60 between the outer edge of the flange 58 and the outer tube 54.

As with the embodiment of FIG. 2, an r.f. power generator 62 (shown schematically) is electrically connected to the launcher 50 via a coaxial cable 64 and an impedance matching network 66 (shown schematically) consisting of capacitors 68 and inductors 70. The r.f. power generator 62, the impedance matching network 66, the coaxial cable 64 and the launcher 50 constitute an r.f. powered excitation device for exciting surface waves in a gas filled discharge body in a similar manner to the arrangement of U.S. Pat. No. 4,049,940. An annular disc 72 of a dielectric material assists in holding the inner tube 52 in position and reduces, to a certain extent, the r.f. interference produced by such an excitation device.

The embodiments of FIGS. 2 to 5 described and illustrated hereinbefore have shown an excitation device in which the impedance matching network is provided inside the launcher. It is also envisaged that part or all of the r.f. power generator may be positioned inside the launcher. In such a case, it is further envisaged that the part of the r.f. power generator positioned inside the launcher could be correctly matched to the launcher/discharge tube without the necessity for a separate impedance-matching network.

Other modifications to the embodiments described herein and within the scope of the present invention will be apparent to those skilled in the art. In particular, it is envisaged that launcher structures need not be limited to those in which both the inner and the outer tube are of circular cross-section. The inner and outer tubes could be of non-circular but similar cross-section, or could be of dissimilar cross-section.

We claim:

1. An excitation device suitable, when energised with radio frequency (r.f.) power, for exciting surface waves in a discharge tube containing a fill, the excitation device comprising:

a launcher comprising an inner tube for surrounding a part of said discharge tube and an outer tube coaxial with said inner tube and a first and a second end wall, at least one of said first and second walls having an aperture for receiving a said discharge tube;

and a plurality of discrete electrical components associated with the supply of r.f. power to the launcher;

wherein said plurality of discrete electrical components is positioned in the launcher between said inner and said outer tubes, said plurality of discrete electrical components constituting an impedance matching network or both an impedance matching network and at least a part of a means to generate r.f. power.

2. An excitation device according to claim 1 wherein said plurality of discrete electrical components is electrically connected to said inner tube.

3. An excitation device according to claim 1 wherein said inner tube and said outer tube have a similar cross-section.

4. An excitation device according to claim 1 wherein at least one of said inner and said outer tubes has a circular cross-section.

5. A discharge tube arrangement comprising an excitation device according to claim 1 and a discharge tube made of a light-transmissive dielectric material and containing a fill.

* * * * *